US010760327B2

(12) United States Patent
Baquet et al.

(10) Patent No.: US 10,760,327 B2
(45) Date of Patent: Sep. 1, 2020

(54) INSULATING GLAZING, IN PARTICULAR FOR A TEMPERATURE-CONTROLLED PIECE OF FURNITURE

(71) Applicant: SAINT-GOBAIN GLASS FRANCE, Courbevoie (FR)

(72) Inventors: Erwan Baquet, Compiègne (FR); Romain Decourcelle, Margny les Compiègne (FR); Edouard Jonville, Courbevoie (FR)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 0 days.

(21) Appl. No.: 16/085,862

(22) PCT Filed: Feb. 23, 2017

(86) PCT No.: PCT/EP2017/054174

§ 371 (c)(1),
(2) Date: Sep. 17, 2018

(87) PCT Pub. No.: WO2017/157633

PCT Pub. Date: Sep. 21, 2017

(65) Prior Publication Data

US 2019/0048651 A1 Feb. 14, 2019

(30) Foreign Application Priority Data

Mar. 18, 2016 (FR) ..... 16 52341

(51) Int. Cl.
*E06B 3/663* (2006.01)
*A47B 67/00* (2006.01)
(Continued)

(52) U.S. Cl.
CPC ..... *E06B 3/66333* (2013.01); *A47B 67/005* (2013.01); *A47F 3/001* (2013.01);
(Continued)

(58) Field of Classification Search
CPC .... E06B 3/66333; E06B 3/02; E06B 3/66309; E06B 2003/6638; E06B 3/673;
(Continued)

(56) References Cited

U.S. PATENT DOCUMENTS 5,290,611 A * 3/1994 Taylor ..... E06B 3/66319 428/137

FOREIGN PATENT DOCUMENTS

FR 2 325 794 A1 4/1977

OTHER PUBLICATIONS

International Search Report as issued in International Patent Application No. PCT/EP2017/054174, dated Apr. 11, 2017.

* cited by examiner

*Primary Examiner* — Donald J Loney
(74) *Attorney, Agent, or Firm* — Pillsbury Winthrop Shaw Pittman LLP

(57) ABSTRACT

An insulating glazing includes at least two substantially parallel glass sheets, which are spaced apart by at least one air- or gas-filled cavity forming a cavity internal to the glazing, a spacer, which is arranged at a periphery of the glass sheets and which keeps the two glass sheets spaced apart, and an adhesive bonding system arranged to fasten the spacer to each glass sheet via two of opposite fastening faces of the spacer, wherein the spacer includes, at least for one side of the glazing, a mirror-function reflective surface on an internal face of the spacer facing the internal cavity of the glazing.

22 Claims, 2 Drawing Sheets

(51) Int. Cl.

| | |
|---|---|
| ***A47F 3/00*** | (2006.01) |
| ***A47F 3/04*** | (2006.01) |
| ***A47G 1/00*** | (2006.01) |
| ***E06B 3/02*** | (2006.01) |
| ***F25D 23/02*** | (2006.01) |
| *E06B 3/673* | (2006.01) |

(52) U.S. Cl.
CPC ..... *A47F 3/0434* (2013.01); *A47G 1/00* (2013.01); *E06B 3/02* (2013.01); *E06B 3/66309* (2013.01); *F25D 23/028* (2013.01); *E06B 3/673* (2013.01); *E06B 3/67304* (2013.01); *E06B 3/67326* (2013.01); *E06B 2003/6638* (2013.01); *F25D 2400/36* (2013.01)

(58) Field of Classification Search
CPC ... E06B 3/67304; E06B 3/67326; A47G 1/00; A47B 67/005; A47F 3/0434; F25D 23/028; F25D 2400/36
See application file for complete search history.

INSULATING GLAZING, IN PARTICULAR FOR A TEMPERATURE-CONTROLLED PIECE OF FURNITURE

CROSS-REFERENCE TO RELATED APPLICATIONS

This application is the U.S. National Stage of PCT/EP2017/054174 filed Feb. 23, 2017, which in turn claims priority to French patent application number 1652341 filed Mar. 18, 2016. The content of these applications are incorporated herein by reference in their entireties.

The invention relates to an insulating glazing in particular intended for a door of a climate-controlled, in particular refrigerated, enclosure/piece of furniture/unit, the insulating glazing comprising at least two glass sheets that are spaced apart by at least one air- or gas-filled cavity by virtue of at least one spacer that is arranged at the periphery of the glass sheets.

The invention also relates to the process for manufacturing such a glazing.

The invention will more particularly be described with regard to an application to a refrigerated unit/display counter, without however being limited thereto. The glazing of the invention may also be used in any other type of application, in particular in building applications, exterior-glazing applications, interior-glazing applications, partition applications, etc.

The glazing may be flat or curved.

A climate-controlled enclosure is more particularly intended to form a chiller unit (temperature above 0° C.) or freezer unit (temperature below 0° C.) in which chilled or frozen products are respectively displayed, these products possibly being items of food or drinks or any other products that need to be kept cold—pharmaceutical products or flowers for example.

Although frozen products are increasingly being sold in units provided with what are called "cold" doors, comprising transparent insulating glazings, at the present time self-service fresh and ultra-fresh items of food are essentially sold by means of vertical units that are open-fronted. Provided at the front with a curtain of refrigerated air in order to isolate the items of food from the warmer ambient environment of the store and to keep the items of food at their optimal preservation temperature, these open-fronted units are quite effective from this point of view and, in the absence of physical barrier, allow products to be accessed directly, facilitating the act of purchase.

However, the absence of physical barrier in these vertical chilled units leads to substantial heat exchange between the ambient environment of the store and the much colder environment inside these units, this having the following consequences:

- this heat exchange must be compensated for by greater refrigeration in order to guarantee temperatures that are optimal for the preservation of food in the unit, this disadvantageously increasing the power consumption of these units;
- the ambient environment of the store is considerably cooled locally (cold-aisle effect), this leading to consumers avoiding venturing into these aisles except for essential purchases, reducing impulse buying. This local cooling of the aisles in question has grown worse over the last few years as the strictness of food-safety regulations has increased and led to the temperature of preservation of foodstuffs being further decreased;

- moist air from the ambient environment of the store is drained by the cold-air curtain of the open-fronted unit, this leading to a rapid saturation of the unit's heat exchanger (also called an evaporator) which ices up, significantly decreasing the efficiency of the heat exchange. It is therefore necessary to frequently de-ice the evaporator, typically two times per day, this leading to an increased power consumption and generating costs.

Confronted with these drawbacks, unit manufacturers have attempted to provide solutions, in particular involving optimizing the air curtains and heating the aisles with radiant heaters or hot-air blowers. The progress made with respect to customer comfort nevertheless remains limited, and is to the detriment of power consumption. Specifically, the heat produced by these heating systems, which guzzle power, also heats the units, and thereby leads in the end to even more power being consumed to refrigerate these units.

Providing these open-fronted units with conventional cold doors allows these drawbacks to be effectively addressed. However, these solutions, which are tried and tested in freezer units for frozen products, have been slow to be adopted in chiller units. These doors have the disadvantage of placing a physical barrier between the consumer and the self-service product, possibly having potentially negative consequences on sales.

Furthermore, these doors are manufactured to a design similar to that of the windows used in buildings: a frame made of profiles, generally made of anodized aluminum for reasons of aesthetics, resistance to ageing and ease of manufacture, frames the entire periphery of a double or triple glazing. The frame is generally adhesively bonded directly to the periphery and to the external faces of the glazing; it participates in the rigidity of the structure and allows the interlayer means (spacers) placed on the periphery of the glazing and separating the glass sheets to be masked from sight.

However, such a structural frame significantly decreases the vision area of the glazing.

It has thus been proposed, to improve the vision area of glazings, to manufacture insulating glazings with transparent spacers at least on their vertical sides, furthermore creating the visual perception that the refrigerated windows placed side-by-side form a continuous transparent area.

However, these transparent spacers make use of specific materials, and must be combined with seal-tight materials that are also transparent in order to form a barrier to water and to gases and water vapor, this increasing the manufacturing cost of the glazing.

Furthermore, these transparent spacers cannot contain a getter (water absorber, also called a desiccant) because the latter would be visible. However, desiccant is useful for absorbing the moisture trapped in the gas-filled cavity on closure of the glass sheets with the spacer.

The aim of the invention is therefore to provide an insulating glazing, in particular for a climate-controlled unit, that obviates the various aforementioned drawbacks, that is simple to implement and that does not increase manufacturing time and manufacturing cost, this in particular being achieved using a conventional spacer, while nevertheless allowing the vision area of the glazing to be increased and while ensuring the desired seal-tightness.

According to the invention, the insulating glazing, which is in particular intended for a door of a climate-controlled, in particular refrigerated, unit/enclosure/piece of furniture, comprises at least two (substantially parallel) glass sheets, which are spaced apart by at least one air- or gas-filled cavity forming a cavity internal to the glazing, a spacer, which is arranged at the periphery of the glass sheets and which keeps the two glass sheets spaced apart and parallel, and adhesive bonding means for fastening the spacer to each glass sheet via two of its opposite faces, which faces are called fastening faces, and is characterized in that the spacer comprises, at least for one side of the glazing, a mirror-function reflective surface on its internal face facing the internal cavity of the glazing (i.e. the face in contact with the air- or gas-filled cavity).

Thus, the mirror-function reflective surface creates an optical illusion that gives an observer located facing, or above all located at an angle with respect to, the front of the glazing, the visual impression that the spacer is invisible, in particular creating, at the junction of two glazings according to the invention, an illusion of transparency and a continuity in the objects arranged behind the glazings.

The expression "mirror-function" is understood to mean that reflects enough light that the edge of the glazing appears transparent, the spacer appears invisible and an object placed behind the glazing and toward the exterior, beyond its edge, remains visible from one end to the other without discontinuity opposite the edge of the glazing.

The term "internal" is understood, in the rest of the description, to refer to that which is in contact with the gas-filled cavity, and the term "external", to that which is, in contrast, on the exterior of the volume in contact with the gas-filled cavity.

Preferably, the spacer is hollow and has a cross section of closed outline. Cross section is considered in a plane transverse to the longitudinal direction of the spacer. Advantageously, the desiccant is housed in the hollow interior of the spacer.

In particular, the mirror-function reflective surface of the spacer is located at least on its internal face facing the internal cavity of the glazing, said surface being porous or comprising orifices in order to allow moisture in the gas-filled cavity to be absorbed by the desiccant housed in the spacer, the spacer having a cross-section of closed outline.

According to one feature, the spacer, with respect to its interlayer function, is a conventional spacer. It may be based on a plastic or a composite and/or on a metal such as stainless steel, steel or aluminum, or even made of glass. It may optionally be transparent.

An example spacer comprises a basic body made of a thermoplastic, such as styrene acrylonitrile (SAN) or polypropylene, reinforced with fibers, such as glass fibers, that are mixed with the thermoplastic, and a sheet that creates the seal tightness to gases and to water vapor, which sheet is adhesively bonded to the face intended to be the external face of the spacer in the position mounted in the glazing (face located opposite the gas-filled cavity). The basic body moreover houses a desiccant.

Such a spacer based on SAN and glass fibers is for example known by the trade name SWISSPACER® of SAINT-GOBAIN GLASS when the seal-tight sheet of the basic body is made of aluminum and under the name SWISSPACER V® when the seal-tight sheet of the basic body is made of stainless steel.

The principle of the invention allows a conventional spacer to be used, the only additional step in the manufacture of the glazing being to provide, on the internal face of the spacer, a mirror-function reflective surface. Therefore, all that needs to be done is to add, to the internal face of a conventional spacer, a mirror-function reflective coating, this having a very small impact, or even no impact at all, on the conventional process used to manufacture an insulating glazing. The term "add" is understood to mean the action of integrating during the manufacture of the spacer, or of depositing after manufacture by any means depending on the nature of the material of the coating, such as by adhesive-bonding means, or of applying, by wet deposition inter alia.

Furthermore, the conventional spacer comprises desiccant (housed in the hollow body of the spacer), guaranteeing the absorption of moisture in the gas-filled cavity. The coating associated with the spacer is also micro-perforated in order to guarantee the exchange of gas between the cavity of the glazing and the desiccant housed in the spacer.

According to a first variant embodiment, the spacer comprises a mirror-function reflective coating that forms the mirror-function reflective surface, said coating being added during the assembly of the spacer into the glazing or added thereto/integrated therein during the manufacture (generally by extrusion) of the spacer in the factory.

According to a second variant embodiment, the mirror-function reflective surface is obtained by the material as such from which the spacer is made. For example, the spacer is made of metal and has, at least on one of its faces, a mirror-function reflective surface. In another example, the spacer is made of plastic, the plastic incorporating metal elements with a reflective surface.

Preferably, the mirror-function reflective surface is associated with the spacer on at least two sides of the glazing, namely the sides intended to be vertical in the position of use of the glazing. If the transparent facade of the unit is arranged not vertically but horizontally, for example for a bench unit, the spacer of the invention is associated at least with the sides that are transverse to the front of the unit. Generally, the spacer of the invention is associated with the sides intended to be placed next to other identical sides of glazings that are placed side-by-side one another.

The mirror-function reflective surface may be associated with the spacer over the entirety of the periphery of the glazing, in particular if the spacer is furnished to manufacture the glazing by integrating said coating.

The material of the mirror-function reflective surface is a material having, on the one hand, a light reflectance ($R_L$) of at least 75%, and preferably of at least 80%, and, on the other hand, a gloss of at least 100 GU under an angle of illumination of 85°.

The glazing according to the invention is therefore such that the material of the mirror-function reflective surface of the spacer is selected to have a light reflectance ($R_L$) of at least 75%, and preferably of at least 80%, and a gloss of at least 100 GU under an angle of illumination of 85°, the material in particular having a light reflectance $R_L$ of 81% and a gloss of 104 GU under an angle of illumination of 85°, or even a light reflectance $R_L$ of 84% and a gloss of 106 GU under an angle of illumination of 85°.

The inventors have demonstrated, surprisingly, that by selecting a material with the above properties and associating it with at least the internal face of the spacer, i.e. the face facing the cavity of the glazing, the spacer becomes as if transparent to a user looking at the glazing from a slightly oblique angle.

By way of example, the mirror-function reflective coating, added to/integrated into the spacer, is made of aluminum, or made of silver or another metal coating, while still having the pair $R_L \geq 75\%$, preferably $R_L \geq 80\%$, and a gloss≥100 (85°).

It will be noted that known spacers made entirely of aluminum, such is the H65 spacer sold by the company ALU PRO, are not suitable because they have a pair that does not meet the criteria; specifically, although this spacer certainly has a gloss of 115 (85°) it has a reflectance of 72%, which is insufficient, the resulting spacer not at all appearing transparent under the conditions of use in an insulating glazing.

In one embodiment, the mirror-function reflective coating is an adhesive film that is adhesively bonded to the spacer, in particular over the entirety of the internal face of the spacer.

In another embodiment, the reflective coating is a thin layer deposited by any known techniques.

The mirror-function reflective coating is porous or comprises orifices, just like the spacer, in order to allow moisture in the gas-filled cavity to be absorbed by the desiccant housed in the spacer.

In one example embodiment of the invention, the insulating glazing comprises at least two substantially parallel glass sheets, which are spaced apart by at least one air- or gas-filled cavity forming a cavity internal to the glazing, a spacer, which is arranged at the periphery of the glass sheets and which keeps the two glass sheets spaced apart, and adhesive bonding means for fastening the spacer to each glass sheet via two of its opposite faces, which faces are called fastening faces, the spacer comprising, at least for one side of the glazing, a mirror-function reflective surface on its internal face facing the internal cavity of the glazing, its mirror-function reflective surface being obtained by the material as such from which the spacer is made, the reflective surface of said material being porous or comprising orifices, in order to allow moisture in the gas-filled cavity to be absorbed by desiccant housed in the spacer (the spacer preferably having a cross section of closed outline).

Preferably, the glazing comprises two seal-tight barriers, a first barrier that is seal tight to water, or to gases and water vapor, and that is formed by the adhesive bonding means for fastening the spacer, and a second seal-tight barrier that is complementary to the first, i.e. if the first barrier is seal tight to water, the second barrier is seal tight to gases and to water vapor, and vice versa.

In one preferred example embodiment, the adhesive bonding means form a seal-tight barrier to gases and to water vapor, said means being made of a material such as butyl rubber, and the glazing comprises a water-tight sealing mastic, such as a polyurethane, polysulfide or silicone mastic, arranged between the glass sheets and on the external face of the spacer opposite the gas-filled cavity.

Preferably, the sealing mastic has a small thickness, i.e. smaller than 3.5 mm, and preferably a thickness of at most 2 mm, in order to minimize the visual impact of this mastic through the glazing; preferably this thickness is at least 1 mm in order to guarantee the seal tightness.

In one embodiment, the spacer has its internal face facing the cavity and its opposite external face in contact with said second seal-tight barrier, said faces each being provided with a mirror-function reflective surface, in particular when the second seal-tight barrier is transparent.

The expression "transparent spacer" is understood to mean allowing at least colors and shapes to be seen therethrough, it not necessarily being possible to read a text behind the transparent spacer.

According to another feature, the glazing is a double glazing or triple glazing.

The glazing may advantageously be provided, on its glass sheets, with one or more low-E coatings and/or an anti-fog or anti-frost layer, thus avoiding conventional heating means, this helping to save energy.

The invention relates, on the one hand, to a door comprising a glazing according to the invention, and, on the other hand, to a climate-controlled unit/piece of furniture, of the refrigerated-unit type, comprising at least one door or one glazing according to the invention, or a plurality of glazings that are placed side-by-side, the spacers provided with their mirror-function reflective surface being placed at least on the sides that are placed side-by-side one another of the glazings.

The invention also relates to the use, in the building field, of one or more glazings according to the invention, in particular in an exterior glazing, or in an interior glazing or in a partition, and in particular in an application requiring a plurality of glazings, the glazings being placed side-by-side one another and the spacers provided with their mirror-function reflective surface being placed at least on the sides that are placed side-by-side one another of the glazings.

Lastly, the invention also relates to a process for manufacturing an insulating glazing comprising at least two (substantially parallel) glass sheets, which are spaced apart by at least one air- or gas-filled cavity forming a cavity internal to the glazing, a spacer, which is arranged at the periphery of the glass sheets and which keeps the two glass sheets spaced apart and parallel, and adhesive bonding means for fastening the spacer to each glass sheet via two of its opposite faces, which faces are called fastening faces, and characterized in that the spacer is selected to comprise, at least for one side of the glazing, a mirror-function reflective surface on its internal face facing the cavity, and in particular selected so that the reflective surface is made of a material having, on the one hand, a light reflectance ($R_L$) of at least 75%, and preferably of at least 80%, and, on the other hand, a gloss of at least 100 GU under an angle of illumination of 85°.

The present invention is now described using merely illustrative and non-limiting examples of the scope of the invention, and with regard to the appended drawings, in which.

The figures are not to scale for the sake of readability.

Figure 1:
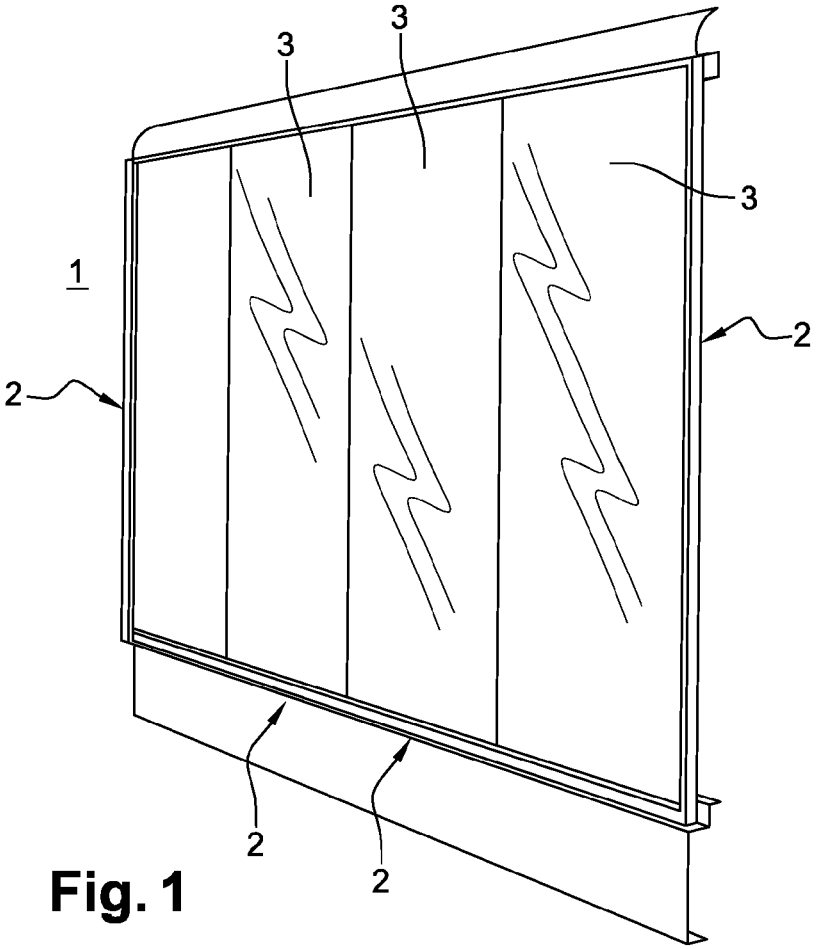
FIG. 1 illustrates a schematic perspective view of a front of a refrigerated unit/piece of furniture incorporating a plurality of glazings according to the invention.

The climate-controlled unit/piece of furniture 1 schematically illustrated in FIG. 1 comprises a plurality of doors 2 each comprising an insulating glazing 3 according to the invention.

The unit is for example a refrigerated chiller unit (temperature above 0° C.) intended to be installed in a store aisle. It is thus possible, according to the invention, to form a unit with a row of doors that are laterally side-by-side vertically along their edge faces.

In the case of a chiller unit/window, since seal tightness is less critical than for a freezer unit (temperature below 0° C.), the door of the invention, which comprise the insulating glazing according to the invention, has no need to comprise vertical jambs forming a frame and provided with thick seals at the junction of two side-by-side glazings/doors. The glazing of the invention thus allows, because of the transparency of its vertical edges, a continuous transparent area to be achieved when glazings are placed side by side via their edge faces.

Each insulating glazing comprises at least two glass sheets that are held parallel and spaced apart by a frame at least the opposite vertical portions of which, in the mounted position of the glazing, are produced with spacers according to the invention.

There is thus an illusion of the front of the glazings and therefore of the unit appearing to be devoid of any structural frame and of continuity of objects placed behind the glass facade and behind the junction line of two side-by-side doors.

Only the vertical portion of the frame of the glazing, i.e. the portion corresponding to the invention, will be described below; the door incorporating the glazing, the hinging means, the profiles supporting and hiding the hinging means, and the type of handle will not be described.

Figure 2:
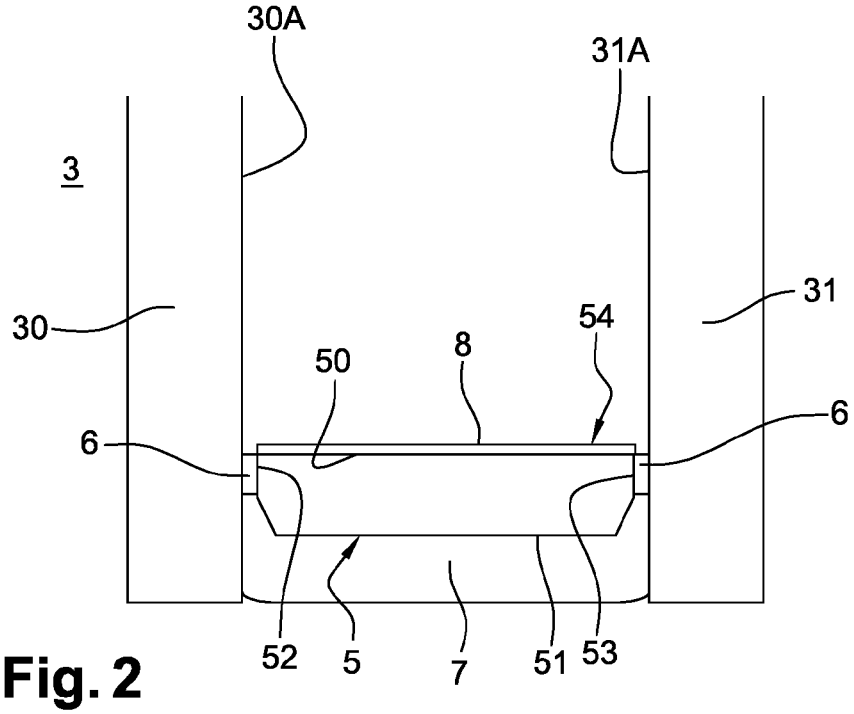
FIG. 2 is a partial cross-sectional view of an insulating glazing with the spacer according to the invention.

FIG. 2 illustrates a partial perspective view of the insulated glazing 3 showing the vertical portion 4 of the interlayer frame of the glazing. The insulating glazing illustrated is a double glazing with two glass sheets. In the case of a triple glazing with three glass sheets, the glazing would comprise two portions 4 with the spacer according to the invention.

The glazing 3 comprises two glass sheets 30 and 31 that are parallel and spaced apart by means of an interlayer element or spacer 5.

The glass sheets 30 and 31 are preferably made of tempered glass. The thickness of each of the glass sheets is comprised between 2 and 5 mm, and is preferably 3 or 4 mm in order to minimize the overall weight of the glazing and to optimize the transmission of light.

The glass sheets are separated from each other by the spacer 5 in order to produce, therebetween, a volume forming a gas-filled cavity 32.

The gas-filled cavity 32 has a thickness of at least 4 mm and is adapted depending on the desired performance in terms of the heat-transfer value U, but is no thicker than 16 mm, or even than 20 mm.

The gas-filled cavity is filled with air or, preferably, in order to increase the level of insulation of the glazing, a rare gas, chosen from argon, krypton, xenon, or a mixture of these various gases, the rare gas making up at least 85% of the gas mixture filling the cavity. For an even further improved U value, it is preferable for the cavity to be filled with a gas mixture containing at least 92% krypton or xenon.

The spacer 5 according to the invention is a conventional insulating-glazing spacer with respect to its interlayer function.

The spacer 5 is of generally parallelepipedal shape and has four faces, a face called the internal face 50 facing the gas-filled cavity, an external opposite face 51 facing the exterior of the glazing, and two what are called fastening faces 52 and 53 facing the respective glass sheets 30 and 31.

The spacer 5 extends lengthwise (here not shown) over the entire length of each of the sides of the glazing. For the targeted refrigerated-unit application, the spacer 5 has the mirror-function feature described below at least on the vertical sides of the glazing.

The spacer has a width (dimension transverse to the general faces of the glass sheets) equivalent to the desired spacing of the glass sheets.

According to the invention, the spacer 5 has a thickness (distance separating the internal face 50 and the external face 51) that is generally about 6 or 8 mm.

By way of example, the spacer is of a SWISSPACER® type, this type of spacer being sold by SAINT-GOBAIN GLASS. It has a body of rectangular cross section that is beveled at its edges on the internal side of the glazing. The body is made of a thermoplastic, such as styrene acrylonitrile (SAN) or polypropylene, reinforced with glass fibers, which are mixed with the thermoplastic. The body is hollow and houses the desiccant.

The spacer 5 is fastened in a known way, by adhesive bonding, by virtue of a structural seal 6 arranged at the interface between each fastening face 52 and 53 of the spacer and each internal face 30A and 31A of the glass sheets 30 and 31, respectively. The structural seal 6 is for example made of butyral rubber and produces a seal-tight barrier to gases and to water vapor.

As usual, a sealing mastic 7 is added to the external face 51 of the spacer and between the glass sheets 30 and 31, coplanar with the edge faces of the glass sheets. This mastic is seal-tight to water. It is for example made of polyurethane, or polysulfide or silicone.

According to the invention, the spacer 5 has, on its internal face 50, a mirror-function reflective surface 54.

The mirror-function reflective surface 54 is preferably made of a coating 8 that is securely fastened to the internal face 15.

The coating is made of a mirror-function reflective material and has, on the one hand, a light reflectance ($R_L$) of at least 75%, and preferably of at least 80%, and, on the other hand, a gloss of at least 100 GU under an angle of illumination of 85°.

By way of example, the mirror-function reflective coating has a light reflectance $R_L$ of 81% and a gloss of 104 GU under an angle of illumination of 85°.

Another example achieving the optical illusion that it is sought to produce with the spacer is a reflective coating the light reflectance $R_L$ of which is 84% and the gloss of which is 106 GU under an angle of illumination of 85°.

The mirror-function reflective coating 8 is an adhesive film that is adhesively bonded to the entirety of the internal face 50 of spacer The mirror-function reflective coating 8 advantageously comprises orifices (not illustrated here) just like the internal face 50 of the spacer, in order to allow moisture in the gas-filled cavity to be absorbed by the desiccant.

Figure 3:
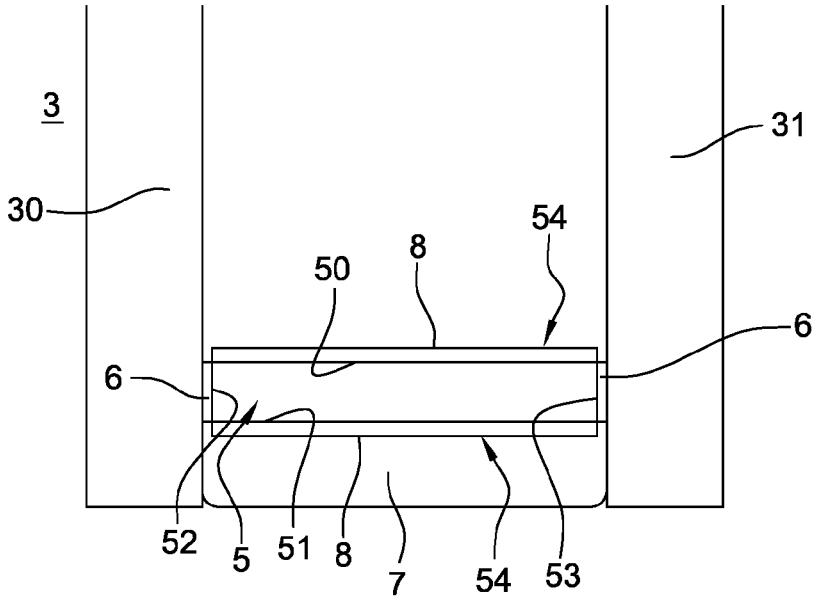
FIG. 3 is a variant of the insulating glazing of the invention, the sealing means of the spacer being transparent.

The spacer illustrated in FIG. 3 has a shape with a more rectangular cross section. Furthermore, the sealing mastic 7 is transparent.

Thus, according to the invention, in this embodiment in which the sealing mastic is transparent, the spacer 5 is provided with a mirror-function reflective surface 54 not only on its internal face 50 but also on its external face 51. The mirror-function reflective surface 54 is for example obtained by adhesive bonding the mirror-function reflective coating 8 of FIG. 2.

The process for manufacturing the glazing of the invention is the following with respect to the manufacture of the spacer and the assembly thereof:

- the spacer is manufactured in a conventional way;
- a coating 8 is selected, said coating having a reflective surface and being made of a material having, on the one hand, a light reflectance ($R_L$) of at least 75%, and preferably of at least 80%, and, on the other hand, a gloss of at least 100 GU under an angle of illumination of 85°;
- the mirror-function reflective coating 8 is added by adhesive bonding to the spacer when it is an adhesive film;
- the spacer is assembled in the conventional way into the glazing.

Therefore, the process according to the invention is simple to implement. The spacer of the invention produced in this way allows, on being assembled at least into the vertical sides of an insulating glazing, an optical illusion to be created at the level of the spacer, this generating the illusion that the frame of the glazing is invisible on the vertical sides. In the mounted position of the glazing in a refrigerated unit, the visual impact of the frame is almost zero, giving the impression of transparency at the junction of a plurality of glazings according to the invention placed side-by-side.

The invention claimed is:

1. An insulating glazing comprising at least two substantially parallel glass sheets, which are spaced apart by at least one air- or gas-filled cavity forming a cavity internal to the glazing, a spacer, which is arranged at a periphery of the glass sheets and which keeps the two glass sheets spaced apart, and an adhesive bonding system arranged to fasten the spacer to each glass sheet via two of opposite fastening faces of the spacer—wherein the spacer comprises, at least for one side of the glazing, a mirror-function reflective surface on an internal face of the spacer facing the internal cavity of the glazing, wherein a material of the mirror-function reflective surface is a material having a light reflectance ($R_L$) of at least 75%, and a gloss of at least 100 GU under an angle of illumination of 85°.

2. The glazing as claimed in claim 1, wherein the spacer comprises a mirror-function reflective coating that forms the mirror-function reflective surface, said mirror-function reflective coating being added during assembly of the spacer with the glazing or added thereto/integrated therein during manufacture of the spacer in a factory.

3. The glazing as claimed in claim 2, wherein the mirror-function reflective coating is porous or comprises orifices in order to allow moisture in the gas-filled cavity to be absorbed by desiccant housed in the spacer.

4. The glazing as claimed in claim 1, wherein the mirror-function reflective surface is obtained by a material as such from which the spacer is made.

5. The glazing as claimed in claim 1 wherein the mirror-function reflective surface is associated with the spacer on at least two sides of the glazing, which at least two sides are intended to be vertical in a position of use of the glazing, or are intended to be placed next to other identical sides of glazings that are placed side-by side one another.

6. The glazing as claimed in claim 1 wherein the glazing comprises two seal-tight barriers, which include a first seal-tight barrier that is seal tight to water, or to gases and water vapor, and that is formed by the adhesive bonding system to fasten the spacer, and a second seal-tight barrier that is complementary to the first such that when the first seal-tight barrier is seal tight to water, the second seal-tight barrier is seal tight to gases and to water vapor, and vice versa.

7. The glazing as claimed in claim 6, wherein the spacer has its internal face facing the cavity and its opposite external face in contact with said second seal-tight barrier, said internal and external faces each being provided with a mirror-function reflective surface.

8. The glazing as claimed in claim 7 wherein the glazing is a double glazing or a triple glazing.

9. A door comprising a glazing according to claim 1.

10. A climate-controlled piece of furniture comprising at least one door as claimed in claim 9.

11. A method comprising arranging one or more glazings according to claim 1 as an exterior glazing, or as an interior glazing or as a partition of a building.

12. A process for manufacturing an insulating glazing comprising: providing at least two substantially parallel glass sheets providing a spacer, and fastening the spacer to each glass sheet via two opposite fastening faces of the spacer with an adhesive bonding system so as to arrange the spacer at the periphery of the glass sheets in order for the spacer to keep the two glass sheets spaced apart by at least one air- or gas-filled cavity forming a cavity internal to the glazing, and wherein the spacer is selected to comprise, at least for one side of the glazing, a mirror-function reflective surface on an internal face of the spacer facing the cavity, and wherein a material of the mirror-function reflective surface is a material having a light reflectance ($R_L$) of at least 75%, and a gloss of at least 100 GU under an angle of illumination of 85°.

13. The glazing as claimed in claim 1, wherein the material of the mirror-function reflective surface has a light reflectance ($R_L$) of at least 80%.

14. The glazing as claimed in claim 13, wherein the material of the mirror-function reflective surface has a light reflectance ($R_L$) of 81% and a gloss of 104 GU under an angle of illumination of 85°.

15. The glazing as claimed in claim 14, wherein the material of the mirror-function reflective surface has a light reflectance ($R_L$) of 84% and a gloss of 106 GU under an angle of illumination of 85°.

16. The glazing as claimed in claim 7, wherein the internal and external faces are each provided with a mirror-function reflective surface when the second seal-tight barrier is transparent.

17. The glazing as claimed in claim 8, wherein the glazing is provided with one or more low-E coatings and/or an anti-fog or anti-frost layer.

18. A climate-controlled piece of furniture comprising a plurality of glazings as claimed in claim 1, the plurality of glazings being placed side-by-side one another, the spacers of said plurality of glazings provided with their mirror-function reflective surface being placed at least on the sides placed side-by-side one another of the glazings.

19. The method as claimed in claim 11, wherein the one or more glazings include a plurality of glazings that are placed side-by-side one another and the spacers of the plurality of glazings provided with their mirror-function reflective surface being placed at least on the sides placed side-by-side one another of the glazings.

20. The process as claimed in claim 12, wherein the reflective surface is made of a material having a light reflectance ($R_L$) of at least 80%.

21. The glazing as claimed in claim 1, wherein the adhesive bonding system is made of butyral rubber.

22. The glazing as claimed in claim 2, wherein the mirror-function reflective coating is porous in order to allow moisture in the gas-filled cavity to be absorbed by desiccant housed in the spacer.

* * * * *